United States Patent [19]

Donnell

[11] 4,027,452

[45] June 7, 1977

[54] EXTRUDED INTERIOR MOLDING

[76] Inventor: James W. Donnell, 945 W. 190th St., Gardena, Calif. 90247

[22] Filed: Apr. 19, 1976

[21] Appl. No.: 677,978

[52] U.S. Cl. ..... 52/716; 52/273; 160/327

[51] Int. Cl.² ..... E04F 19/02; E04F 13/00

[58] Field of Search .... 52/254, 287, 288, 716–718, 52/242, 220, 273; 160/327

[56] References Cited

UNITED STATES PATENTS

| | | | |
|---|---|---|---|
| 1,910,554 | 5/1933 | Loehr et al. | 52/254 |
| 3,310,899 | 3/1967 | Hart et al. | 160/392 |
| 3,413,775 | 12/1968 | Katz | 52/254 |
| 3,707,061 | 12/1972 | Collette et al. | 52/717 |

*Primary Examiner*—Price C. Faw, Jr.
*Assistant Examiner*—James L. Ridgill, Jr.
*Attorney, Agent, or Firm*—Fulwider, Patton, Rieber, Lee & Utecht

[57] ABSTRACT

There is disclosed an extruded plastic molding intended for use as interior corner molding for wall paneling and the like. The molding is particularly suited for the interior corner between wall and ceiling paneling employed in mobile homes or motor vehicles such as vans and the like since the molding has channel and groove means to receive adjacent panels at included angles from 90 to about 130 degrees. The molding comprises a first flange and a second flange coextensive therewith at an included angle from 90 to about 130 degrees with a coextensive, bulbous, hollow-form section which has one side wall parallel to and spaced apart from the first flat flange to define a narrow channel therebetween. The opposite side of the bulbous hollow form section has a rabbet groove parallel to and spaced apart from the second flat flange. The channel and rabbet groove receive the adjoining edges of the wall paneling. The outer edge of the channel defined by the wall of the bulbous, hollow-form section has a smooth radius of curvature whereby the channel can receive the edge of a flat panel which has an angle from 90 to about 130 degrees to the opposite flat flange. The hollow-form section provides a longitudinal through passageway which can receive electrical conduit and the like. In other embodiments, the hollow-form section can bear one or more longitudinal grooves adjacent the rabbet groove that can be used as tracks for sliding hardware such as hardware for draperies, paintings, tapestries, sliding lights and the like.

8 Claims, 5 Drawing Figures

FIG. 1
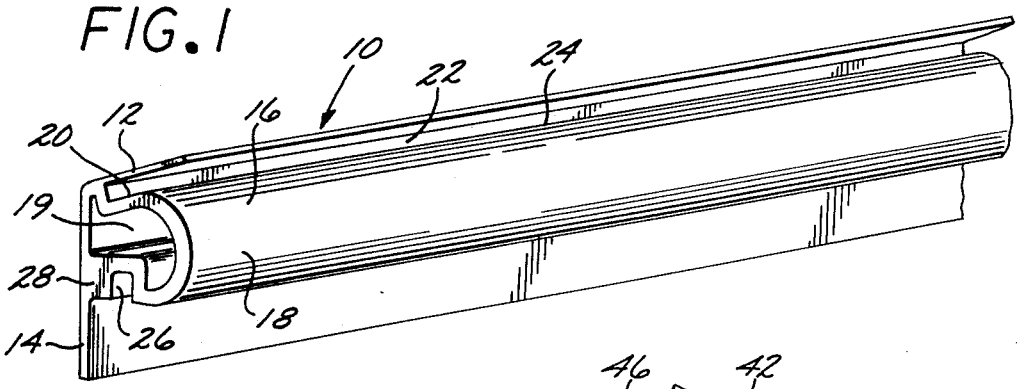
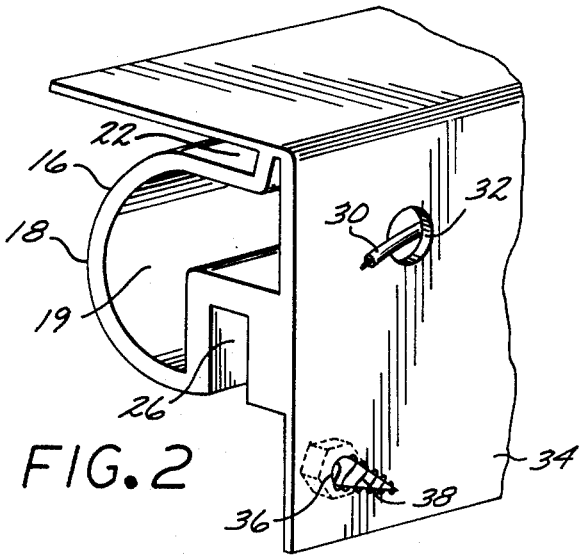
FIG. 2
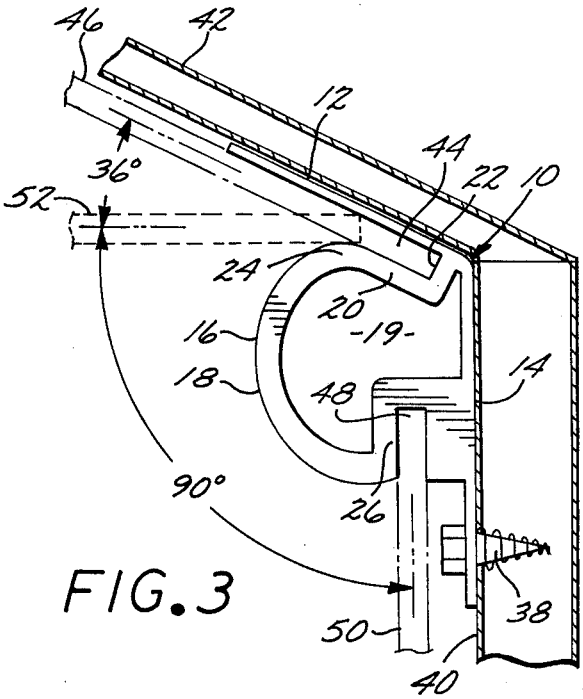
FIG. 3
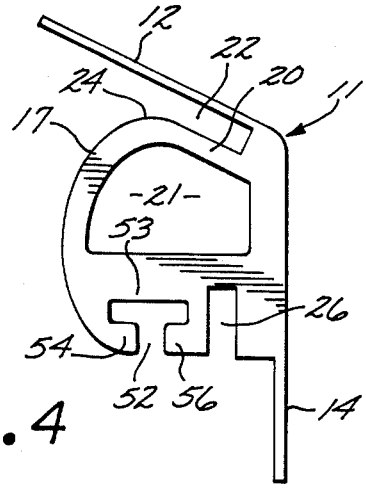
FIG. 4
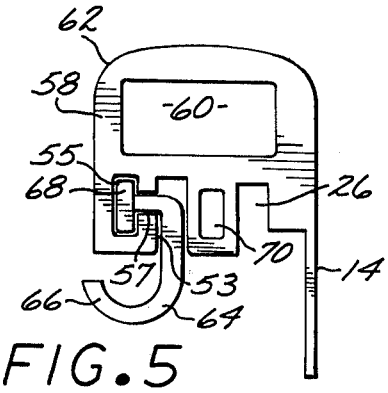
FIG. 5

EXTRUDED INTERIOR MOLDING

BACKGROUND OF THE INVENTION

Extruded plastic molding has been employed for mating the adjoining edges of wall paneling. Typically, the extrusion comprises a double channel design such as an I-joint for mating of coplanar paneling sheets or a double channel, right angle molding for use with interior corners.

While the prior extruded plastic moldings have a slight degree of flexing to accommodate minor misalignments of adjoining panels, the panels must, nevertheless, be in substantial coplanar or orthogonal alignment. Accordingly, the prior plastic extrusions cannot be employed to dress the interior corners between ceiling and wall panels in a typical vehicular van construction where the interior roof is at an obtuse angle to the wall. Additionally, the prior extruded moldings are not provided with hollow-form sections that could serve as reinforcement and as carriers for electrical wiring and the like.

BRIEF STATEMENT OF THE INVENTION

This invention comprises an extruded plastic molding for use as dress and reinforcement for interior corners of paneled walls and ceilings. The molding includes a first generally flat flange with a second generally flat flange coextensive therewith at an included angle of from 90° to about 130°, preferably from about 120° to about 130°. The molding also includes a bulbous, hollowform section coextensive with the flat flange members. The bulbous, hollow-form section is positioned with one side wall parallel to and spaced apart from the first flat flange member to define a narrow channel therebetween and bears, on its opposite side wall, a rabbet groove substantially parallel to and spaced apart from said second flat flange member. In alternative embodiments, the bulbous, hollow-form section can also include exterior groove means that serve as tracks for sliding hardware such as drapery carriers and the like. The latter groove means is positioned adjacent the rabbet groove.

The invention is employed as an interior corner molding for adjoining the mating edges of wall paneling and the like. The molding is ideally suited for interior corner dress of the joint between the wall and ceiling panels in a van which can have an included angle between these panels from 120 to about 130 degrees. In this structure, the ceiling panel is received in the channel and the wall paneling is received in the rabbet groove. The edge of the channel defined by the bulbous, hollow-form section has a smooth radius of curvature to provide accommodation for variations in included angles between the wall and ceiling of the structure while, nevertheless, providing a secure reinforcement for the joint. The hollow form section can be used as a carrier for electrical wiring and the like and in the optional embodiments the additional groove means can be used to support drapery hardware and the like.

BRIEF DESCRIPTION OF THE DRAWINGS

The preferred embodiment of the invention will be described with reference to the drawings, of which:

FIG. 1 is a perspective view of the extruded molding of the invention;

FIG. 2 illustrates the backside of the extruded molding of the invention;

FIG. 3 is a sectional view through a wall panel joint employing the molding of the invention;

FIG. 4 is a sectional view of another embodiment of the invention; and

FIG. 5 is a sectional view of another embodiment of the invention.

DESCRIPTION OF PREFERRED EMBODIMENTS

Referring now to FIG. 1, the invention is illustrated as an extension formed with a first flat flange member 12, a second flat flange member 14 at an included angle thereto of from 90° to about 130°, preferably from about 115° to about 130° and a coextensive, hollow-form section 16. The hollow-form section 16 is generally bulbous, with a convex outer surface 18. The side wall 20 which is opposite flat flange member 12 is parallel thereto and is spaced apart therefrom to define a narrow channel 22 therebetween. The bulbous section edge 24 of channel 22 has a smooth radius of curvature to provide a rounded edge for a function hereinafter described in greater detail.

The opposite side wall of bulbous section 16 bears a rabbet groove 26 which is generally parallel to and spaced apart from the second flat flange member 14 by a slight distance thereby providing the continuous shoulder 28 along flange member 14.

As shown in FIG. 2, the longitudinal cavity 19 within the bulbous, hollow-form section 16 serves as a carrier for wiring 30 and the like as well as reinforcement for the continuous molding 10. The flange member 14 can be provided with one or more apertures 32 communicating with the continuous cavity 19 to permit entrance and egress of wiring 30, as desired. The lower portion 34 of flange member 14 can be also provided with a plurality of apertures 36 to receive screw fasteners 38 and the like for securing the molding 10 to a flat, structural surface such as a wall and the like.

Referring now to FIG. 3, the invention is illustrated in an elevation sectional view typical of a paneling installation. As there illustrated, the molding 10 is secured with the backside of flange member 14 secured to a flat structural surface such as a wall 40 and the like by screw fasteners such as self tapping screws 38 and with its opposite flat flange member 12 bearing against a structural surface such as roof 42 and the like. This installation is typical of a van interior wherein roof 42 has an included angle with the walls thereof of approximately 126 degrees. In this position, channel 22 is generally parallel to the roof 42 and can receive the edge 44 of a roof ceiling panel 46. The rabbet groove 26 is generally parallel to wall 40 and receives the edge 48 of wall panel 50, thereby providing a dressed and reinforced joint between panels 46 and 50. The continuous cavity 19 of the bulbous, hollow-form section 16 extends coextensively with the interior corner between panels 46 and 50 to function as a carrier for wiring and the like.

As previously mentioned, the side of bulbous section 16 opposite flat flange member 12 bears a smoothly rounded edge 24. This structure accommodates adjoining panels having an included angle from 90 degrees such as illustrated with panel 52 (shown in broken lines) to the maximum included angle of about 130 degrees shown for panel 46. This permits use of the extrusion molding to fit a variety of vans having a widely varied included angle between the ceiling and walls.

Referring now to FIG. 4, there is illustrated an embodiment of the invention as an extruded molding 11 which has a first flat flange member 12 and 14 similar to those previously described. The molding includes a generally bulbous, coextensive, hollow-form section 17 having an interior cavity 21 similar to cavity 18 previously described. The bulbous section 17 has a side wall 20 opposite flange member 12, generally parallel to and spaced apart therefrom. This configuration defines the coextensive channel 22 such as previously described, including the rounded edge 24, also previously described.

The opposite side wall of bulbous section 17 bears a rabbet groove 26 for receiving the edge of a wall panel and the like, also as previously described. The bulbous section 17, however, has an additional longitudinal groove 52 which is generally parallel to and spaced apart from rabbet groove 26. Groove 52 serves as a track to receive sliding hardware and the like such as the carriers or hooks of conventional drapery hardware which can be used to support draperies, tapestries, paintings, etc. To this end, the groove is provided with at least one and preferably two lips 54 and 56 coextensive with its length to provide offset shoulders for retaining carriers and the like. The embodiment as illustrated in FIG. 4 can be employed with simple curtain or drapery riders having no traverse cord and the like. Groove 52 can also be a track to receive the base of spot lights and the like in a sliding adjustable support. The wiring for the lights can be extended through the longitudinal cavity 21 and extending to the lights through apertures in wall 53.

If desired, the molding can be modified to provide an additional longitudinal cavity parallel to groove 52 which can serve for the return of cords of traverse rods and the like. Such a construction is illustrated in FIG. 5. As there illustrated, flat flange members 12, previously described have been removed or eliminated from the molding. The coextensive, hollow-form section 58 has a central longitudinal cavity 60. Preferably, the forward face of hollow form section 58 has a rounded edge to provide tolerance in the fit of the molding to a panel surface such as the ceiling or panel supported thereon. Rabbet groove 26 is provided on the opposite side wall of bulbous section 58 to receive the edge of wall panels and the like, as previously described.

The undersurface of bulbous section 58 has a longitudinal groove 53 which communicates with a coextensive and parallel longitudinal cavity 55 through interconnecting slot 57, thereby defining a track to receive the traverse carriers 64 having a generally hook-shaped end 66 and retainer flange 68 on its opposite end for engagement in cavity 55. In the preferred embodiment, the bulbous section 58 also bears a coextensive, longitudinal cavity 70 that parallels the slot 53 and thereby provides for return of traverse cords and the like. The cords are received within cavity 70 and extend out of cavity 70 through a distal aperture that can support pulleys and the like over which the traverse cords are passed as they exit from cavity 70.

The extruded moldings can be formed of any suitable plastics, typical of which are polyvinyl chloride, polypropelene, copolymers of acrylinitrile-butedyene-styrene, etc. If desired, the moldings can also be extruded of metals such as aluminum and the like, however, the aforementioned plastics are preferred.

The invention has been described with reference to the illustrated and presently preferred embodiment thereof. It is not intended that the invention be unduly limited by the illustrated and described preferred mode of practice. Instead, it is intended that the invention be described by the means, and their obvious equivalents, set forth in the following claims.

What is claimed:

1. An inside corner molding formed by tubular extrusion comprising:

a first flat flange member;

a second flat flange member coextensive therewith at an included angle thereto of from 90° to about 130°;

a bulbous, hollow-form section formed with a curvilinear wall, coextensively carried on said first flange and having a tangential side wall parallel to and opposite said second flange contiguous with said curvilinear wall and spaced apart therefrom to define a longitudinal channel therebetween having a curvilinear, diverging entrance;

a longitudinal rabbet groove in the opposite side wall of said bulbous, hollow-form section coextensive with, parallel to and spaced apart from said first flange member.

2. The tubular extrusion of claim 1 including a second, longitudinal groove in said opposite side wall.

3. The tubular extrusion of claim 2 wherein said second longitudinal groove bears inwardly directed lip means extending coextensively along at least one edge thereof.

4. The tubular extrusion of claim 2 wherein said second longitudinal groove bears an inwardly directed lip along both, opposite edges thereof.

5. The tubular extrusion of claim 1 wherein said second flat flange member bears a plurality of apertures communicating with the interior thereof.

6. The combination of a structure having an interior corner and surfaces adjoining therein which comprises:

a tubular extrusion of claim 1 positioned in said interior corner with its first and second flat flange members secured to said adjoining surfaces; and panels of sheet material covering said surfaces and projecting into edge engagement with said longitudinal channel and said longitudinal rabbet groove.

7. The combination of claim 6 wherein said corner has an included angle from 90° to about 130°.

8. The combination of claim 6 wherein said corner has an included angle from 100° to about 130°.

* * * * *